US012258719B2

(12) United States Patent
Ustach et al.

(10) Patent No.: US 12,258,719 B2
(45) Date of Patent: Mar. 25, 2025

(54) PROTECTIVE BARRIER

(71) Applicant: McCue Corporation, Danvers, MA (US)

(72) Inventors: Thomas Ustach, Boston, MA (US); Teodoro A. Mesa, Lynn, MA (US)

(73) Assignee: McCue Corporation, Danvers, MA (US)

( * ) Notice: Subject to any disclaimer, the term of this patent is extended or adjusted under 35 U.S.C. 154(b) by 753 days.

(21) Appl. No.: 17/496,148

(22) Filed: Oct. 7, 2021

(65) Prior Publication Data

US 2022/0106749 A1 Apr. 7, 2022

Related U.S. Application Data

(60) Provisional application No. 63/088,648, filed on Oct. 7, 2020.

(51) Int. Cl.
*E01F 15/14* (2006.01)
*E01C 11/22* (2006.01)

(52) U.S. Cl.
CPC ..... *E01F 15/146* (2013.01); *E01C 11/222* (2013.01)

(58) Field of Classification Search
CPC ..... E01F 15/146; E01F 15/0438; E01F 9/623; E01F 9/627; E01F 9/50; E01F 9/535; E01F 9/541; E01C 11/222
See application file for complete search history.

(56) References Cited

U.S. PATENT DOCUMENTS 5,192,157 A * 3/1993 Laturner ..... E01F 15/146 404/6
5,791,811 A * 8/1998 Yoshino ..... E01F 15/043 404/6
6,533,495 B1 * 3/2003 Williams ..... E01F 15/0453 404/6
6,840,706 B1 * 1/2005 Camomilla ..... E01F 15/043 404/6
D862,270 S * 10/2019 Povoli ..... D10/113.3
2003/0210954 A1 * 11/2003 Kang ..... E01F 15/146 404/6
2004/0119303 A1 * 6/2004 Gollungberg ..... B60R 19/56 293/132
2005/0242334 A1 * 11/2005 King ..... E01F 15/0438 256/13.1
2006/0013651 A1 * 1/2006 Williams ..... E01F 15/145 404/6
2008/0145144 A1 * 6/2008 Desrosiers ..... E01C 11/222 404/7

(Continued)

*Primary Examiner* — Abigail A Risic
(74) *Attorney, Agent, or Firm* — Occhiuti & Rohlicek LLP

(57) ABSTRACT

A protective barrier includes an angle bracket having a length extending from a first end to a second end of the protective barrier. The angle bracket includes a first elongate leg member having a first edge extending along the length of the angle bracket, the first elongate member having a first side configured to be mounted to a surface, a second elongate leg member extending along the length of the angle bracket and substantially perpendicular from the first elongate leg member, and an impact absorber extending from the first end to the second end of the protective barrier, the impact absorber being compressible and configured to be disposed on the angle bracket.

15 Claims, 10 Drawing Sheets

(56) References Cited

U.S. PATENT DOCUMENTS

| | | | | |
|---|---|---|---|---|
| 2014/0270937 | A1* | 9/2014 | Kulkarni | E01F 9/535<br>404/6 |
| 2018/0187386 | A1* | 7/2018 | Povoli | E01F 9/565 |
| 2020/0115864 | A1* | 4/2020 | Mesa | E01F 15/06 |
| 2021/0102351 | A1* | 4/2021 | Mesa | E01F 15/143 |
| 2023/0034715 | A1* | 2/2023 | Smith | E01F 9/541 |

* cited by examiner

PROTECTIVE BARRIER

CROSS-REFERENCES TO RELATED APPLICATIONS

This application claims the benefit of U.S. Provisional Application No. 63/088,648, filed Oct. 7, 2020.

BACKGROUND OF THE INVENTION

This invention relates to a protective barrier.

Warehouses, distributions centers, factories, and similar facilities often have large stock handling equipment such as fork trucks and tuggers, which frequently move stock into, out of, and around the facility. In some examples, the stock is stored on shelving (e.g., pallet racks) and stock handling equipment must navigate through the shelving to move stock to and from the shelving. Some facilities may have other obstacles (e.g., support columns, walls, pedestrian walkways) which the stock handling equipment must navigate around as it travels through the facility.

As an operator navigates stock handling equipment through a facility, it is possible for the operator to inadvertently cause the stock handling equipment to collide with obstacles such as shelving, support columns, or walls or to encroach on pedestrian walkways. When stock handling equipment collides with an obstacle, both the obstacle and the stock handling equipment can become damaged. In the case of shelving, a strong enough collision can cause the shelving to collapse. In the case of an encroachment on a pedestrian walkway, a pedestrian can be seriously injured.

Because of the dangers associated with stock handling equipment, barriers are often installed to protect obstacles and walkways in facilities from interactions with stock handling equipment.

The presence of barriers in facilities with stock handling equipment presents its own problem in that there is a potential for workers in the facilities to be caught between the barriers and the stock handling equipment. For example, a pedestrian walking through the facility could be caught between a barrier and a fork truck, causing injury. Similarly, an operator of a fork truck might, for example, have their foot dangling outside of the fork truck pinched between a barrier and the fork truck. Accordingly, there is a need for solution to prevent workers from being caught between barriers and stock handling equipment.

SUMMARY OF THE INVENTION

In a general aspect, a ground-level protective barrier is designed to be installed adjacent to a second protective barrier such that, when a stock handing vehicle strikes the ground-level protective barrier, a predefined clearance distance is maintained between the stock handling vehicle and the second protective barrier. The predefined clearance distance is defined to ensure that, for example, a limb or an entire person can fit between the first, ground-level protective barrier and the second protective barrier without being injured (e.g., pinched or crushed).

In another general aspect, a protective barrier includes an angle bracket having a length extending from a first end to a second end of the protective barrier. The angle bracket includes a first elongate leg member having a first edge extending along the length of the angle bracket, the first elongate member having a first side configured to be mounted to a surface, a second elongate leg member extending along the length of the angle bracket and substantially perpendicular from the first elongate leg member, and an impact absorber extending from the first end to the second end of the protective barrier, the impact absorber being compressible and configured to be disposed on the angle bracket.

Aspects may include one or more of the following features.

The second elongate leg member may have a second edge extending along the length of the angle bracket, where the second edge may be attached to the first edge of the first elongate leg member. The first elongate leg member may have a second side, opposite the first side and the second elongate leg member may have a second edge extending from the second side of the first elongate member. The second edge of the second elongate may be spaced from the first edge of the first elongate leg member.

The first elongate leg may include a number of first through holes sized and may be configured to receive first fasteners to secure the first elongate leg member to the surface. The second elongate leg may include a number of second through holes sized and configured to receive second fasteners to secure the impact absorber to the second elongate leg member. The impact absorber may have a floor-facing surface having a first width and the first side of the first elongate leg has a second width, the second width being less than the first width.

The impact absorber may include an elongate channel extending along a length of the impact absorber, the elongate channel sized and shaped to receive the angle bracket. The elongate channel may be L-shaped. The elongate channel may be T-shaped. The impact absorber may include an impact-receiving surface and a rear surface, and when the impact absorber is in a compressed condition, the impact-receiving surface is deformed and the rear surface is not deformed.

The impact absorber may include a truss structure defining voids. The structure may define voids. The truss structure may include a first truss section having a first thickness and a second truss section having a second thickness, the first thickness being greater than the second thickness. The truss structure may include a first truss section having a first flexibility characteristic and a second truss section having a second flexibility characteristic, the first flexibility characteristic being greater than the second flexibility characteristic.

Among other advantages, aspects establish a clearance between barriers and stock handling equipment to prevent workers or their limbs from being trapped, caught, pinched, and/or crushed between the barriers and stock handling equipment, thereby preventing injury to the workers.

Aspects advantageously receive impacts with little or no bowing of the protective barrier, thereby preventing the protective barrier from entering prohibited areas (e.g., pedestrian walkways) and injuring workers.

Other features and advantages of the invention are apparent from the following description, and from the claims.

DETAILED DESCRIPTION

Figure 1:
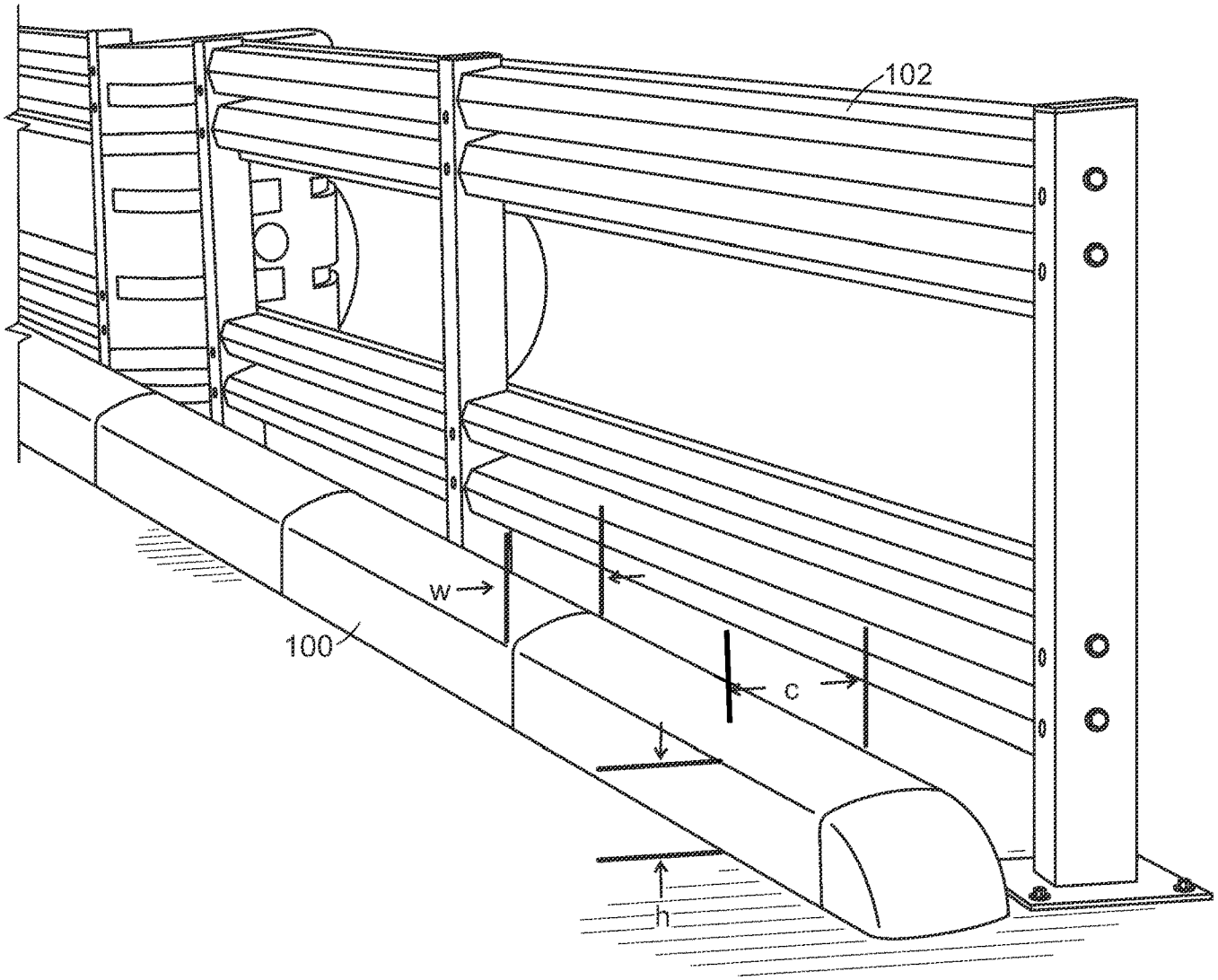
FIG. 1 is a protective barrier installed in a facility.

Referring to FIG. 1, a protective barrier 100 is installed on the ground in a facility such as a warehouse. The protective barrier 100 is installed adjacent to another, taller barrier 102 (e.g., a guard rail barrier). Very generally, protective barrier 100 is configured to maintain a clearance, c between any material handling vehicle that strikes the protective barrier 100 and the taller barrier 102. The clearance, c is configurable based on where the protective barrier 100 is installed relative to the taller barrier 102 and a compressibility of the barrier 100. In general, the clearance, c is chosen to be a distance that is sufficient to accommodate a person or a limb of a person. If a person or a limb of a person happens to be in the clearance, c when a material handling vehicle strikes the protective barrier 100, the person or limb will not be crushed between the protective barrier 100 and the taller barrier 102.

In some examples, the height, h of the protective barrier 100 is specified to be just tall enough to ensure that a lower part of a material handling vehicle will strike the protective barrier 100 rather than passing or driving over it. In some examples the height, h is also kept as small as possible to reduce an area where a limb or person could be caught and crushed between the protective barrier 100 and a stock handling vehicle. In some examples, the width, w of the protective barrier 100 is large enough to accommodate so workers in the facility can safely step on the protective barrier without risk of injury (e.g., twisting an ankle).

Figure 2:
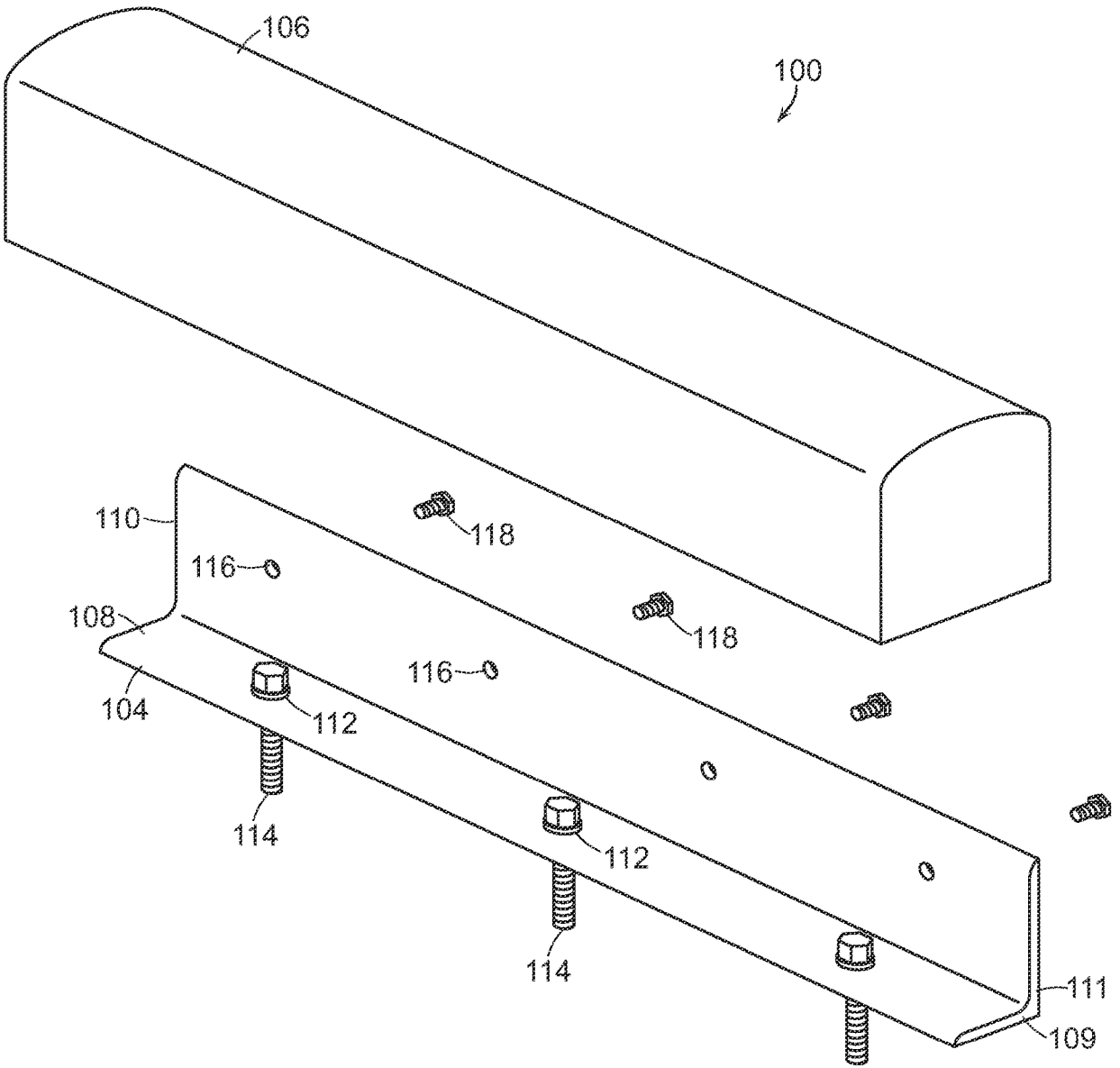
FIG. 2 is an exploded view of a protective barrier.

Referring to FIG. 2, in some examples, the protective barrier 100 includes an angle bracket 104 and an impact absorber 106. The angle bracket 104 is a rigid elongate member with a first elongate leg 108 and a second elongate leg 110. The first elongate leg 108 has a first edge 109 extending along its length and the second elongate leg 110 has a second edge 111 extending along its length. The first edge 109 of the first elongate leg 108 is attached to the second edge 111 of the second elongate leg 110 such that the first elongate leg 108 and the second elongate leg 110 are arranged substantially perpendicular to one another, resulting in the angle bracket 104 having an L-shaped cross section.

The first elongate leg 108 includes a number of through holes 112 though which fasteners 114 extend to secure the protective barrier 100 to a surface (not shown). When the protective barrier is installed on a surface, the first elongate leg 108 lays on the surface and the fasteners 114 extend through the through holes 112 and into the surface, securing the angle bracket 104 to the surface.

The second elongate leg 110 includes a number of through holes 116 thorough which fasteners 118 extend to secure the impact absorber 106 to the angle bracket 104 (as is described in greater detail below.

Figure 3:
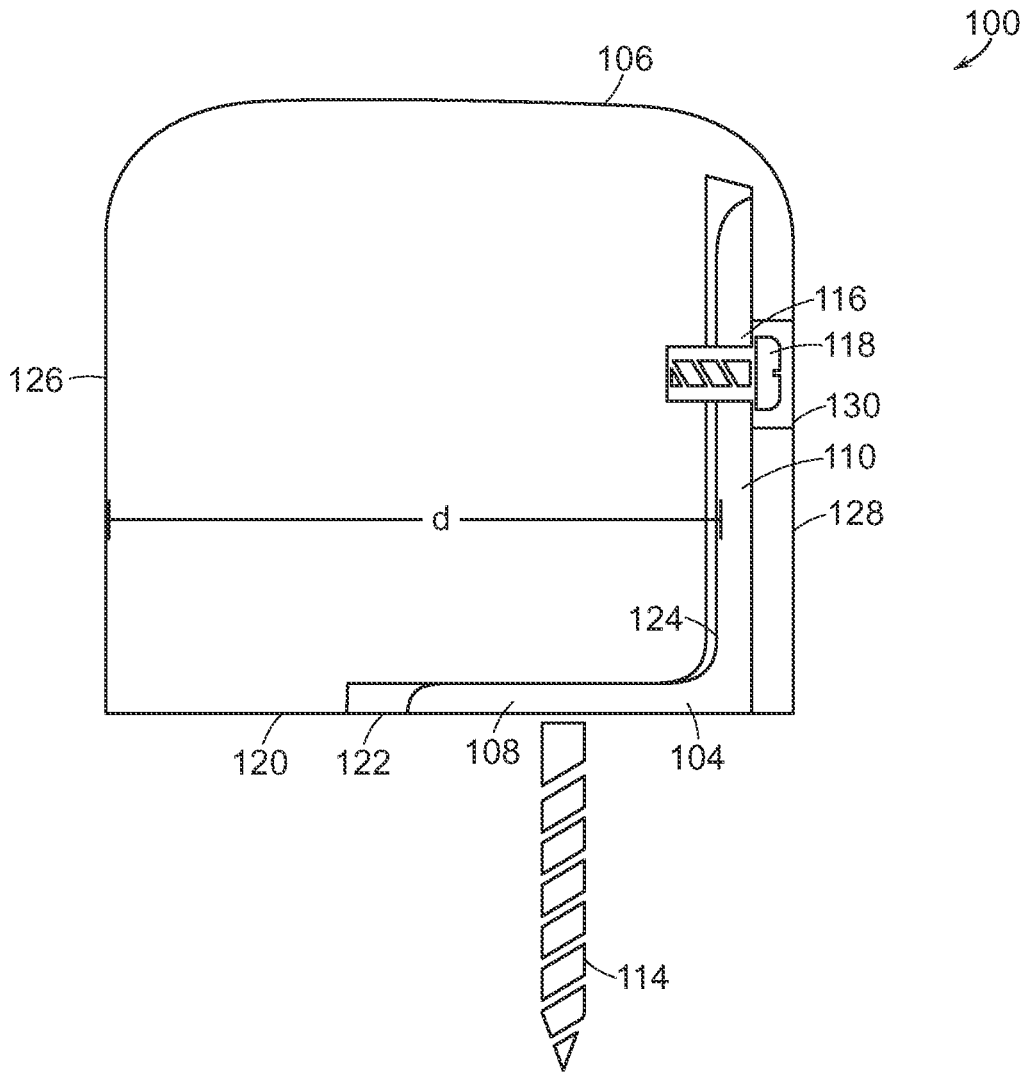
FIG. 3 is a side cross-sectional view of the protective barrier of FIG. 2.

The impact absorber 106 is an elongate compressible and/or flexible member configured to be installed on and fastened to the angle bracket 104. Referring to FIG. 3, the impact absorber 106 includes a floor-facing surface 120, an impact receiving surface 126, and a rear surface 128.

The floor-facing surface 120 includes an opening 122 into an elongate, L-shaped channel 124 extending along a length of the impact absorber 106 and sized and shaped to receive the angle bracket 104. When the angle bracket 104 is received in the elongate channel 124, the second elongate leg 110 of the angle bracket 104 is adjacent to the rear surface 128 of the impact absorber 106 and is separated by a distance, d from the impact receiving surface 126 of the impact absorber. The first elongate leg 108 extends from the second elongate leg 110 toward the impact receiving surface 126 but, in general, does not extend the full distance, d to the impact receiving surface 126 such that the first elongate leg 108 remains covered by the impact absorber 106.

The impact absorber 106 is secured to the angle bracket 104 by inserting the fasteners 118 into through holes 130 in the rear surface 128 of the impact absorber 106, through the through holes 116 in the second elongate leg 110, and into the impact absorber 106 where the fasteners are held (e.g., by a threaded connection).

Figure 5:
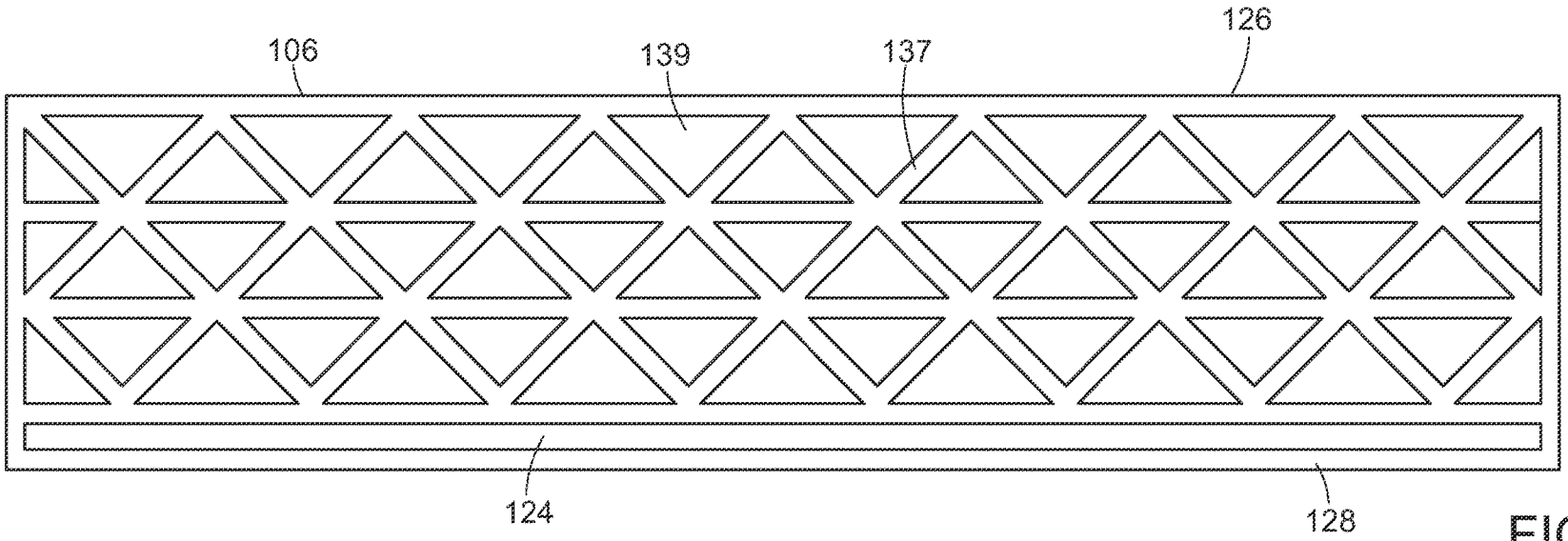
FIG. 5 is an uncompressed impact absorber.
Figure 6:
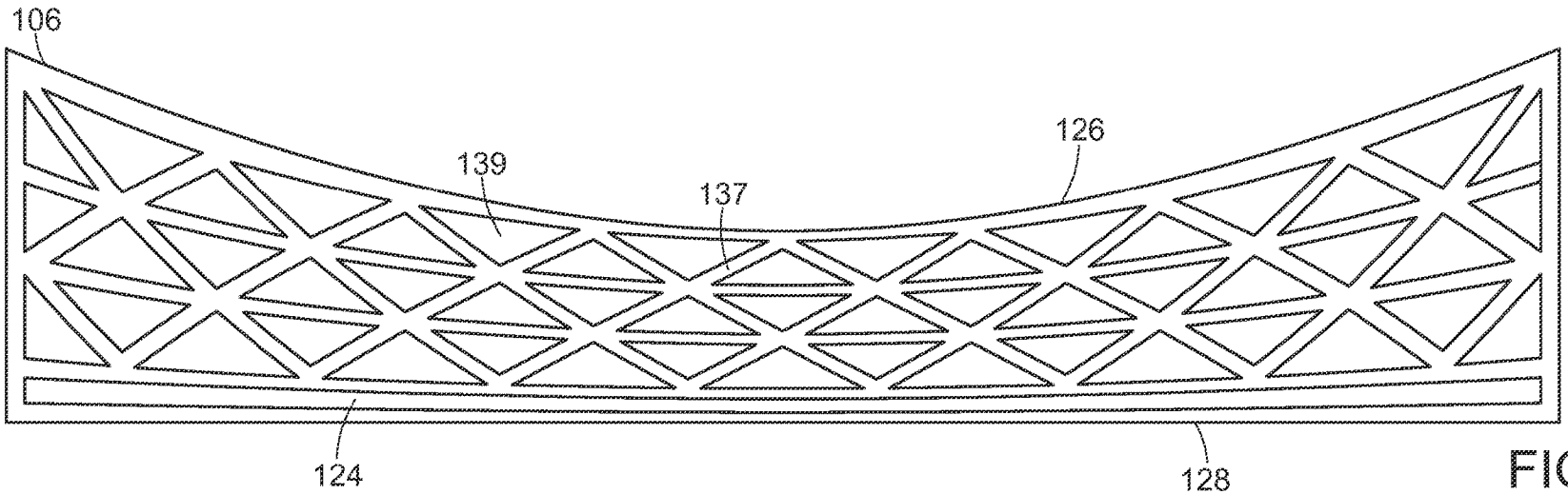
FIG. 6 is a compressed impact absorber.

Referring to FIGS. 5 and 6, in some examples, the interior space of the impact absorber 106 includes a truss structure 137 defining voids 139 that allows the impact absorber 106 to compress when it is struck. For example, in FIG. 5, the impact absorber 106 is in an uncompressed condition and in FIG. 6, the impact absorber is in a compressed condition. In FIG. 6, note that, while the impact receiving surface 126 is compressed and curved (e.g., due to an impact) the rear surface 128 is not curved due to the presence of the rigid angle bracket 104, which prevents or minimizes deformation of the rear surface 128.

In some examples, a material thickness of the truss sections can be adjusted to modify the impact absorption properties of the impact absorber 106. For example, some or all of the truss sections can be made thicker to make impact absorber able to receive higher energy impacts, or to reduce the amount of possible compression of the impact absorber 106. Alternatively, some or all of the truss sections can be made thinner to increase the amount of possible compression of the impact absorber 106. In other examples, materials with different flexibilities and/or compressibilities can be used in the impact absorber 106 to modify its impact absorption properties. In some examples, the impact absorption properties of the impact absorber 106 are used to control the clearance between stock handling vehicles and barriers, the amount of energy that the barrier can withstand, and how forgiving the barrier is to impacts.

In some examples, patterns other than truss patterns can be used inside of the impact absorber. For example, a honeycomb pattern could be used.

Figure 7:
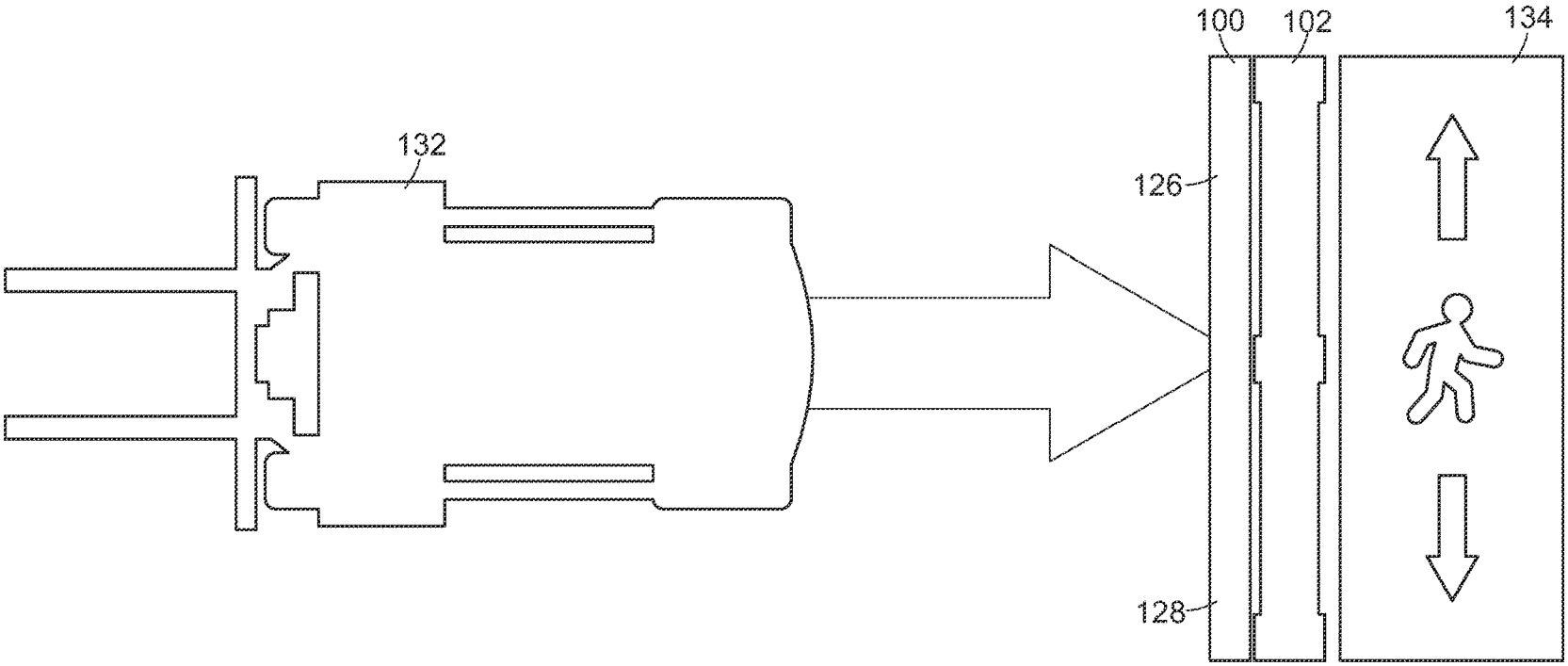
FIG. 7 is a collision scenario involving the protective barrier.
Figure 8B:
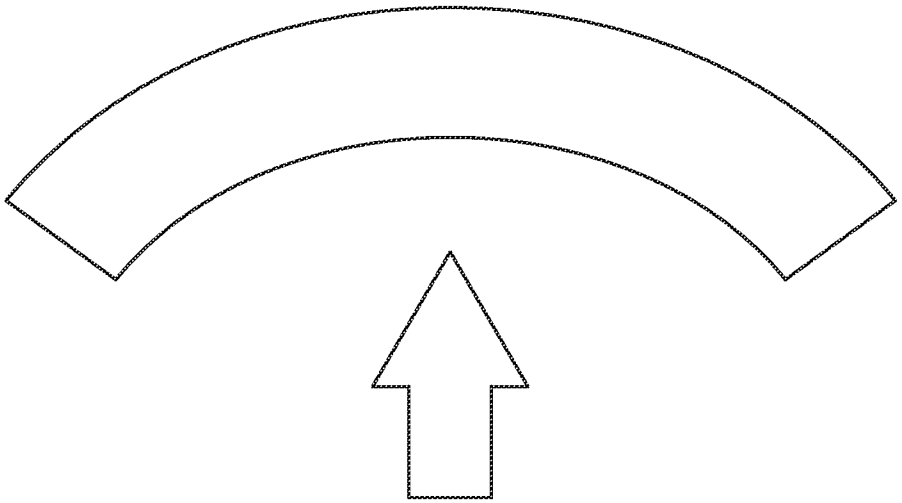
FIG. 8*b* is a bowed barrier.
Figure 8A:
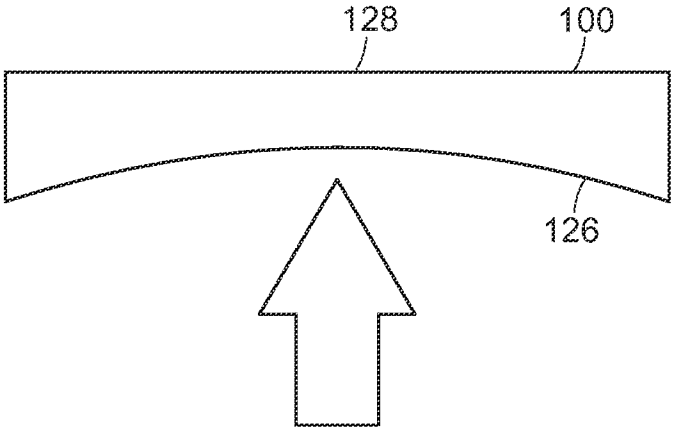
FIG. 8*a* is a compressed view of the protective barrier.

Referring to FIGS. 7, 8*a*, and 8*b*, when a material handling vehicle 132 strikes the protective barrier 100, the barrier compresses as in FIG. 8*b* rather than "bowing" out as in FIG. 8*a*. Prevention of such bowing (provided by the inclusion of the rigid angle barrier 104) is desirable, for example when a pedestrian walkway 134 is located behind the protective barrier 100 as in FIG. 7.

Figure 4:
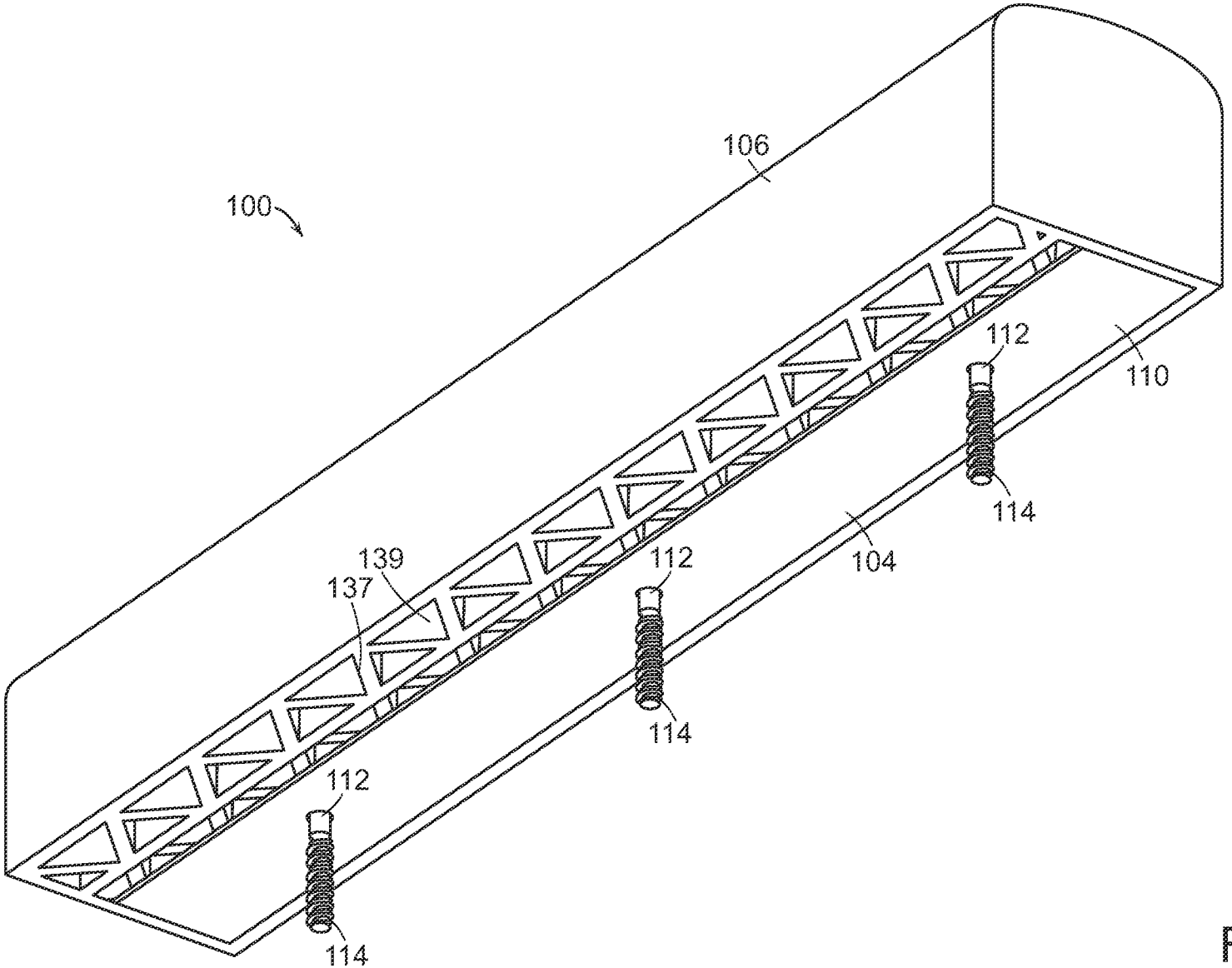
FIG. 4 is a perspective view of the bottom of the protective barrier of FIG. 2.
Figure 9:
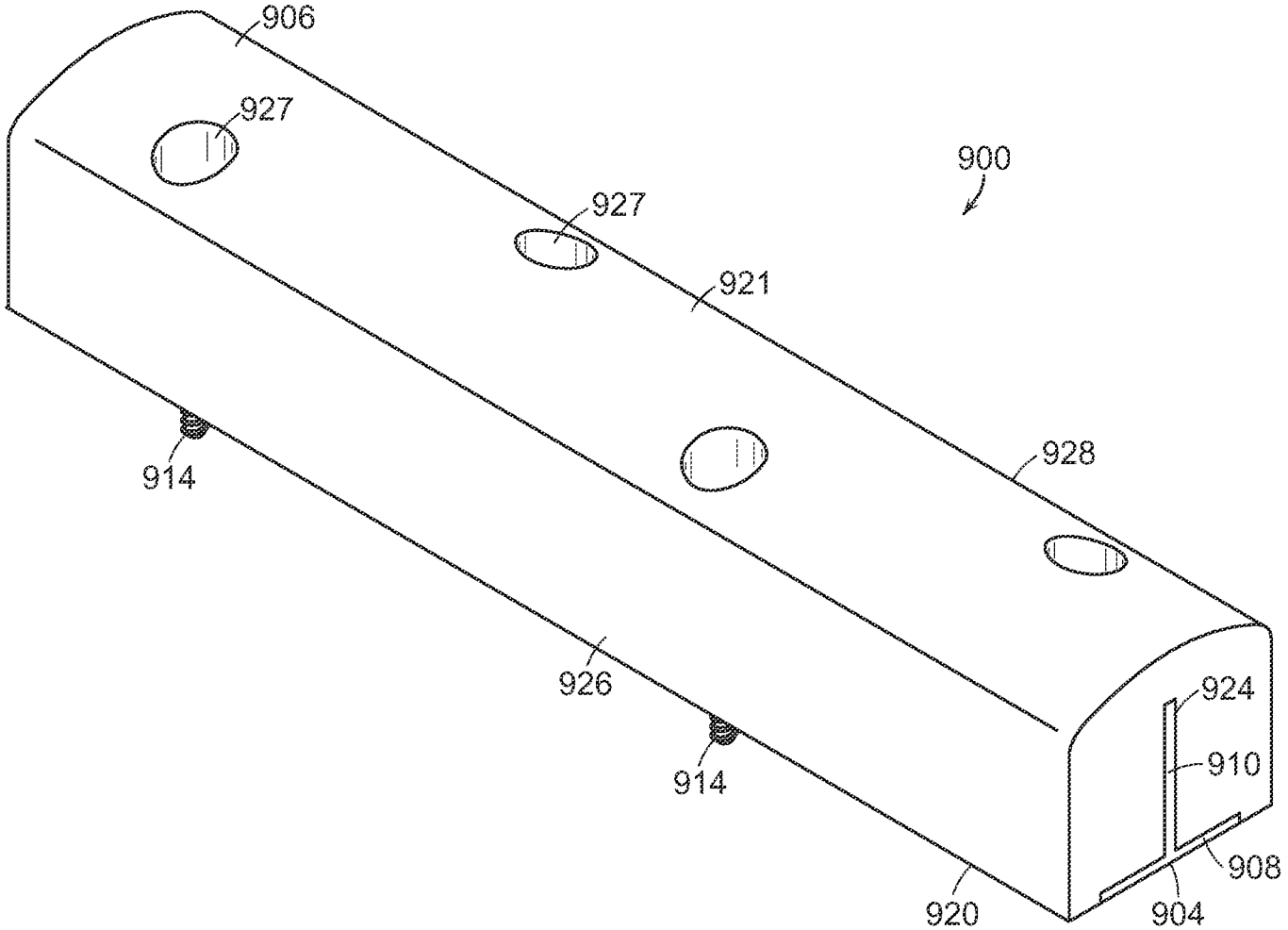
FIG. 9 is a second protective barrier.
Figure 10:
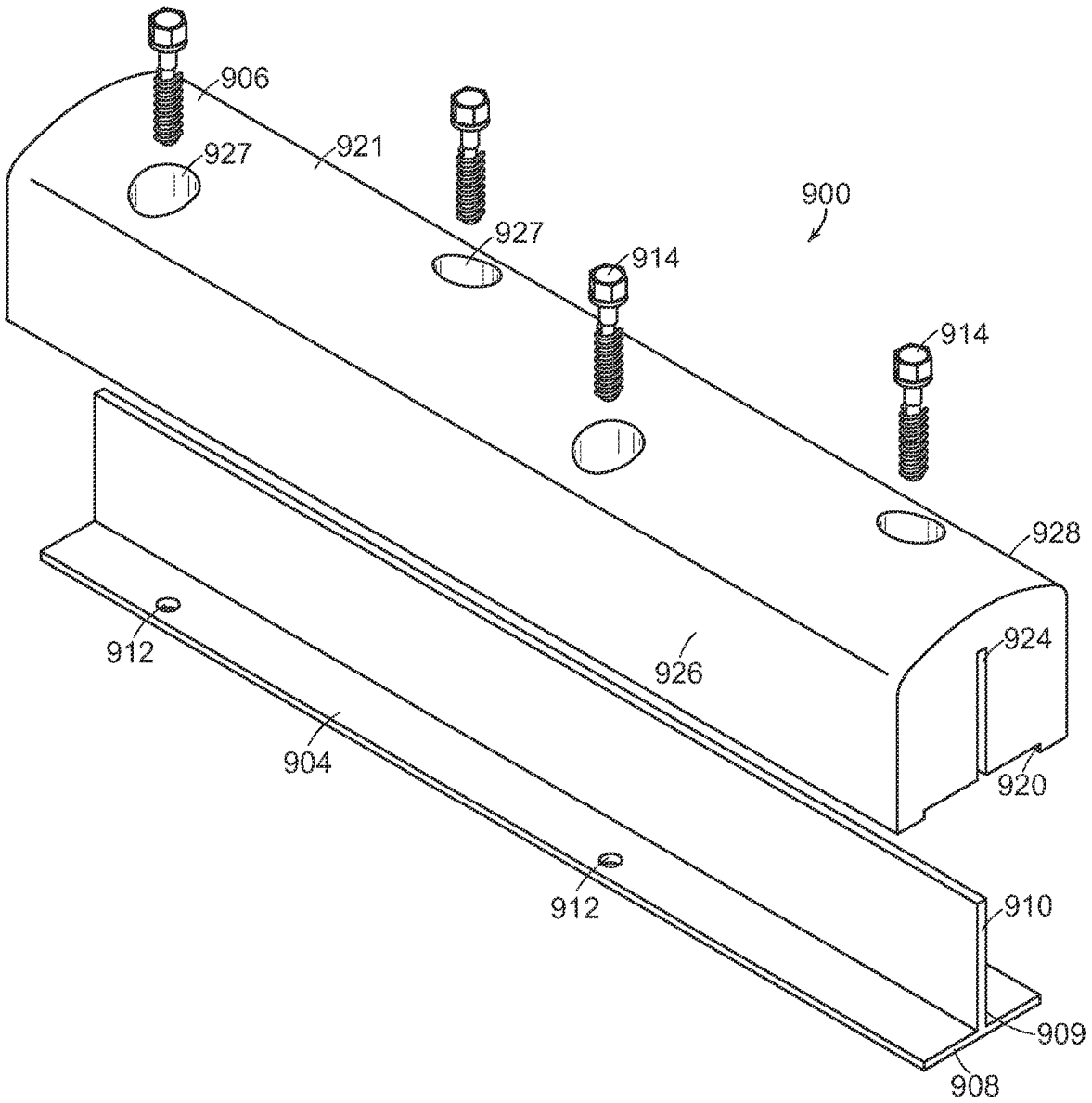
FIG. 10 is an exploded view of the second protective barrier of FIG. 9.
Figure 11:
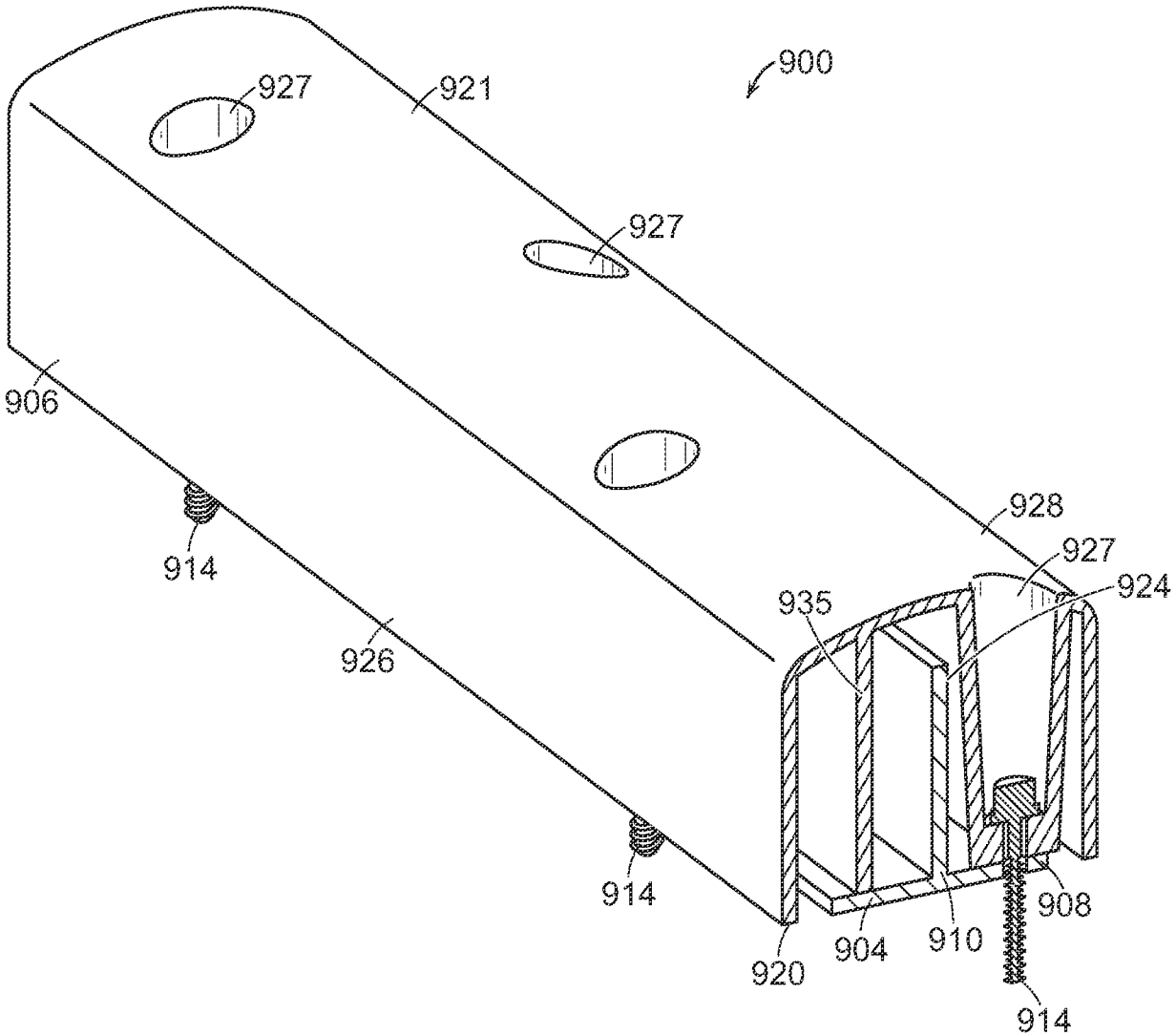
FIG. 11 is a perspective, cut-away view of the second protective barrier of FIG. 9.

Referring to FIGS. 9-11, another example of a protective barrier 900 has a design similar to the protective barrier 100 described above. However, rather than having only one impact absorbing face (as in the protective barrier 100 of FIGS. 2-4), the protective barrier 900 has two impact absorbing faces (i.e., it is configured to be impacted on both sides).

In some examples, the protective barrier 900 includes a T-bracket 904 and an impact absorber 906. The T-bracket 904 is a rigid elongate member including an elongate mounting plate 908 with an elongate leg 910 extending therefrom. An edge 909 extending along a length of the elongate leg 910 is attached to the center of the mounting plate 908 and extends along the length of the mounting plate 908. The mounting plate 908 and the elongate leg 910 are arranged substantially perpendicular to one another, resulting in the T-bracket 904 having a T-shaped cross section.

The mounting plate 908 includes a number of through holes 912 though which fasteners 914 extend to secure the protective barrier 900 to a surface (not shown).

The impact absorber 906 is an elongate compressible and/or flexible member configured to be installed on and fastened to the T-bracket 904. The impact absorber 106 includes a floor-facing surface 920, a first impact receiving surface 926, and a second impact-receiving surface 928. The impact absorber also includes a number of through holes 927 extending from its top surface 921 to its floor-facing surface 920.

The floor-facing surface 920 includes an opening 922 into an elongate channel 924 extending along a length of the impact absorber 106 and sized and shaped to receive the elongate leg 910 of the T-bracket 904 (e.g., the elongate channel 924 is T-shaped). When the elongate leg 910 is received in the elongate channel 924, the elongate leg 910 extends substantially down the center of the impact absorber 908.

When the protective barrier is installed on a surface, the mounting plate 908 lays on the surface and the elongate leg 910 is inserted into the elongate channel 924 of the impact absorber 906. The fasteners 914 extend through the through holes 927 of the impact absorber 906, through the through holes 912 of the mounting plate, and into the surface, securing the T-bracket 904 to the surface and holding the impact absorber 906 captive on the T-bracket 904.

The interior space of the impact absorber 906 can include a truss or honeycomb structure as described above. Alternatively, the interior space can include one or more ribs 935 extending through the impact absorber 906.

When the protective barrier 900 is struck, it compresses and behaves much as the protective barrier 100 described above behaves, with the exception that the protective barrier 900 is designed to be struck on either side.

1 Alternatives

In some examples, the height of the protective barrier is in a range of four inches to two feet. In some examples, the width of the protective barrier is in a range of three inches to one foot. In some examples, the impact absorber of the protective barrier is compress in a range of 5% to 75% of its original width when struck.

In some examples, the impact absorber is made of a resilient polymer such as HDPE. In other examples, the impact absorber is made of an elastomer. In some examples, the angle (or T) bracket is made of a rigid stainless-steel material. In other examples, the angle (or T) bracket is made of a rigid plastic.

A number of embodiments of the invention have been described. Nevertheless, it is to be understood that the foregoing description is intended to illustrate and not to limit the scope of the invention, which is defined by the scope of the following claims. Accordingly, other embodiments are also within the scope of the following claims. For example, various modifications may be made without departing from the scope of the invention. Additionally, some of the steps described above may be order independent, and thus can be performed in an order different from that described.

What is claimed is:

1. A protective barrier comprising:

T-shaped bracket having a length extending from a first end to a second end of the protective barrier, the T-shaped bracket including:

a first elongate leg member extending along the length of the T-shaped bracket, the first elongate member including a first plurality of through holes and having a first side configured to be mounted to a surface;

a second elongate leg member extending along the length of the T-shaped bracket and coplanar with the first elongate leg member, the second elongate leg member including a second plurality of through holes and having a second side configured to be mounted to the surface; and a third elongate leg member extending in a first direction along the length of the T-shaped bracket and from a region where the first elongate leg member and the second elongate leg member meet, the third elongate leg member extending in a second direction away from and substantially perpendicular to the first elongate leg member and the second elongate leg member; and an elongate impact absorber extending from the first end to the second end of the protective barrier, the impact absorber being compressible and configured to be disposed on the T-shaped bracket, the elongate impact absorber including a T-shaped cavity configured to receive the T-shaped bracket, and a plurality of openings configured to align with the first plurality of through holes and the second plurality of through holes when the elongate impact absorber is disposed on the T-shaped bracket; and a plurality of fasteners configured to extend through the plurality of openings of the elongate impact absorber and through the first plurality of through holes and the second plurality of through holes to fasten the T-shaped bracket and the elongate impact absorber to the surface.

2. The protective barrier of claim 1, wherein the first elongate leg member has a top side, opposite the first side; and the third elongate leg member has a second edge extending from the top side of the first elongate member.

3. The protective barrier of claim 2, wherein the second edge of the second elongate is spaced from the first edge of the first elongate leg member.

4. The protective barrier of claim 1, wherein the impact absorber has a floor-facing surface having a first width and the first side of the first elongate leg has a second width, the second width being less than the first width.

5. The protective barrier of claim 1, wherein the T-shaped cavity includes an elongate channel extending along a length of the impact absorber, the elongate channel sized and shaped to receive the T-shaped bracket.

6. The protective barrier of claim 1, wherein the impact absorber includes an impact-receiving surface and a rear surface, and when the impact absorber is in a compressed condition, the impact-receiving surface is deformed and the rear surface is not deformed.

7. The protective barrier of claim 1, wherein the impact absorber includes a truss structure.

8. The protective barrier of claim 7, wherein the truss structure defines voids.

9. The protective barrier of claim 7, wherein the truss structure includes a first truss section having a first thickness and a second truss section having a second thickness, the first thickness being greater than the second thickness.

10. The protective barrier of claim 7, wherein the truss structure includes a first truss section having a first flexibility characteristic and a second truss section having a second flexibility characteristic, the first flexibility characteristic being greater than the second flexibility characteristic.

11. The protective barrier of claim 1 wherein the impact absorber is formed from an elastomer.

12. The protective barrier of claim 11 wherein the T-shaped bracket is formed from a metallic material.

13. The protective barrier of claim 1 wherein the impact absorber is formed from a high-density polyethylene material.

14. The protective barrier of claim 1 wherein each fastener of the plurality of fasteners holds a part of the elongate impact absorber captive between a head of the fastener and the T-shaped bracket.

15. The protective barrier of claim 1 wherein the surface is a ground surface.

* * * * *